US010934508B2

(12) United States Patent
Hasinovic et al.

(10) Patent No.: US 10,934,508 B2
(45) Date of Patent: Mar. 2, 2021

(54) ALKYL HYDROXYBUTYRATE CLEANING COMPOSITION AND METHOD OF CLEANING AIR INTAKE VALVE DEPOSITS

(71) Applicant: Valvoline Licensing and Intellectual Property, LLC, Lexington, KY (US)

(72) Inventors: Hida Hasinovic, Lexington, KY (US); David E. Turcotte, Lexington, KY (US)

(73) Assignee: Valvoline Licensing and Intellectual Property LLC, Lexington, KY (US)

( * ) Notice: Subject to any disclaimer, the term of this patent is extended or adjusted under 35 U.S.C. 154(b) by 55 days.

(21) Appl. No.: 16/333,106

(22) PCT Filed: Mar. 10, 2017

(86) PCT No.: PCT/US2017/021849
§ 371 (c)(1),
(2) Date: Mar. 13, 2019

(87) PCT Pub. No.: WO2018/052483
PCT Pub. Date: Mar. 22, 2018

(65) Prior Publication Data

US 2019/0359914 A1 Nov. 28, 2019

Related U.S. Application Data

(63) Continuation-in-part of application No. PCT/US2016/051476, filed on Sep. 13, 2016.

(60) Provisional application No. 62/220,273, filed on Sep. 18, 2015.

(51) Int. Cl.

| | |
|---|---|
| ***C11D 1/722*** | (2006.01) |
| ***C11D 11/00*** | (2006.01) |
| ***C11D 3/20*** | (2006.01) |
| ***C11D 3/32*** | (2006.01) |
| ***C11D 17/00*** | (2006.01) |
| ***C11D 1/835*** | (2006.01) |
| ***B08B 3/10*** | (2006.01) |
| ***C11D 7/26*** | (2006.01) |
| ***C11D 7/32*** | (2006.01) |
| ***C11D 7/50*** | (2006.01) |
| ***B08B 3/08*** | (2006.01) |
| ***B08B 9/027*** | (2006.01) |
| ***C11D 1/66*** | (2006.01) |
| ***C11D 3/43*** | (2006.01) |
| ***F02B 77/04*** | (2006.01) |
| ***F02M 35/10*** | (2006.01) |
| *C11D 1/52* | (2006.01) |

(52) U.S. Cl.
CPC ..... *C11D 11/0041* (2013.01); *B08B 3/08* (2013.01); *B08B 3/10* (2013.01); *B08B 9/027* (2013.01); *C11D 1/66* (2013.01); *C11D 1/835* (2013.01); *C11D 3/20* (2013.01); *C11D 3/2093* (2013.01); *C11D 3/32* (2013.01); *C11D 3/43* (2013.01); *C11D 7/266* (2013.01); *C11D 7/3263* (2013.01); *C11D 7/5022* (2013.01); *C11D 11/00* (2013.01); *C11D 11/0029* (2013.01); *C11D 17/00* (2013.01); *C11D 17/0021* (2013.01); *F02B 77/04* (2013.01); *F02M 35/10255* (2013.01); *B08B 2203/007* (2013.01); *C11D 1/521* (2013.01)

(58) Field of Classification Search
CPC ..... C11D 1/66; C11D 3/2093; C11D 3/32; C11D 11/0041; C11D 17/0021
See application file for complete search history.

(56) References Cited

U.S. PATENT DOCUMENTS

| | | | | |
|---|---|---|---|---|
| 5,407,453 | A * | 4/1995 | Pierce-Ruhland | C11D 3/2079 44/302 |
| 5,852,942 | A * | 12/1998 | Sharp | D06F 37/262 68/3 R |
| 10,077,417 | B2 * | 9/2018 | Hasinovic | C11D 17/0021 |
| 2003/0031964 | A1 * | 2/2003 | Hayward | C11D 3/2058 431/3 |
| 2008/0010774 | A1 * | 1/2008 | Erwin | B08B 9/045 15/304 |
| 2008/0011327 | A1 | 1/2008 | Shriner et al. | |
| 2012/0071377 | A1 * | 3/2012 | Huo | C11D 7/265 510/185 |

(Continued)

FOREIGN PATENT DOCUMENTS

| | | | |
|---|---|---|---|
| FR | 2815639 | A1 | 4/2002 |
| WO | 0246588 | A1 | 6/2002 |
| WO | 2005091771 | A2 | 10/2005 |

(Continued)

OTHER PUBLICATIONS

International Searching Authority, Search Report and Written Opinion issued in corresponding International Application No. PCT/US2017/021849 dated Mar. 19, 2019, 8 pages.

(Continued)

*Primary Examiner* — Charles I Boyer
(74) *Attorney, Agent, or Firm* — Wood Herron & Evans LLP

(57) ABSTRACT

A cleaning composition is particularly suited for cleaning dirty intake valves. The cleaning composition includes a high solvency surfactant/solvent which has a Kb greater than 100 or polar Hansen solubility parameter greater than 6. The surfactant/solvent is combined with an organic carrier and a surfactant. A wetting agent may also be employed. The cleaning composition is added to the intake air as a mist as the engine is running.

18 Claims, No Drawings

(56) References Cited

U.S. PATENT DOCUMENTS

| | | | | |
|---|---|---|---|---|
| 2015/0225676 | A1* | 8/2015 | De Wit | C23G 1/24<br>510/401 |
| 2017/0015898 | A1* | 1/2017 | Beach | C09K 8/86 |

FOREIGN PATENT DOCUMENTS

| | | | |
|---|---|---|---|
| WO | 2006051255 | A1 | 5/2006 |
| WO | 2015017175 | A1 | 2/2015 |
| WO | 2015134163 | A1 | 9/2015 |

OTHER PUBLICATIONS

Santos, J., et al., "Development of eco-friendly emulsions produced by microfluidization technique," Journal of Industrial and Engineering Chemistry, Feb. 2016, pp. 90-95, vol. 36, Elsevier B.V. (6 pages).

* cited by examiner

ALKYL HYDROXYBUTYRATE CLEANING COMPOSITION AND METHOD OF CLEANING AIR INTAKE VALVE DEPOSITS

CROSS-REFERENCE TO RELATED APPLICATIONS

This application is a U.S. National Phase submission under 35 U.S.C. § 371 of International Application No. PCT/US2017/021849, filed Mar. 10, 2017, which claims priority to PCT/US2016/51476, filed Sep. 13, 2016, which claims priority to U.S. Application No. 62/220,273, filed Sep. 18, 2015, the disclosures of which are hereby expressly incorporated by reference herein in their entireties.

BACKGROUND OF THE INVENTION

Gasoline direct injected engines directly add fuel to the combustion chamber bypassing the intake valves for efficient combustion. Some of the exhaust and crankcase vapor gas is recirculated back to the air intake and over the intake valves. This can cause a buildup of a carbonaceous material on and around the manifold and air intake valves, which eventually decreases fuel efficiency and performance.

Some of this deposit can be removed by adding a cleaning composition into the air intake. Current cleaning compositions that are generally organic solvent-based are suitable only for gasoline engines and are unsuitable for diesel engines. The fuel value of the solvents causes unintended increases in engine acceleration, sometimes resulting in damage from uncontrolled or run away combustion.

SUMMARY OF THE INVENTION

According to the present invention, a cleaning composition is used to clean intake valves of gasolineengines by injecting the cleaning composition into the air intake of the engine as the engine is running. The cleaning composition dissolves and removes the oily carbonaceous buildup on the intake valves.

The cleaning composition uses a solvent/surfactant with fuel value and organic carriers for use in gasoline engines.

DETAILED DESCRIPTION

The cleaning composition of the present invention used for gasoline engines includes anon-aqueous organic carrier, an organic solvent which has a high solvency and no fuel value, along with an appropriate surfactant and a wetting agent.

The organic solvent also referred to as a surfactant/solvent used in the present invention must have a high solvency effective to dissolve oil, such as the oil in the carbonaceous buildup on the intake valves. Solvency can be defined by either the Kauri-butanol value or the Hansen solubility parameter. When defined by the Kb value, which is measured by ASTM D1133, the organic solvent should have a solvency of at least 100 and more typically 500, 1000 or higher than 1000. There are three different Hansen solubility parameters: the dispersive parameter; the polar parameter; and the hydrogen bonding parameter. The polar parameter is more predictive of the ability of the solvent to dissolve oily compositions. Generally, the polar parameter should be at least 6, preferably 6.4 or higher, such as 9.5 or greater. Solvents with either the high Kb value or high polar Hansen solubility parameter can be used in the present invention. One such solvent is Steposol® SC from Stepan Company.

Another such solvent is Omnia from Eastman Chemical Co. Another such solvent is TomaKleen G-12 from Air Products and Chemicals, Inc. Another such solvent is Radia 7543 from Oleon. Other such solvents include VertecBioElsolTR and VertecBio Clean ECO-Solv from VertecBioSolvents.

The high solvency organic solvent should have fuel value to make it suitable for use in a gasoline engine. The carrier must combust in the gasoline engine. Thus, the spark generated by the spark plug of the gasoline engine should cause the organic solvent to combust.

One type of high solvency organic solvent suitable for the present invention is an alkyl substituted fatty amide such as an N,Ndialkyl fatty acid amide, in particular, N,N-Dimethyl-9-decenamide. This organic solvent has a solvency greater than 1000 and also has the following Hansen solubility parameters: dispersive: 16.58, polar: 9.58, and hydrogen bonding: 8.45. One such alkyl substituted fatty amide is Steposol® MET-10U from Stepan Company.

Other fatty acid amides and amide esters having a high solvency can be used. Many of these are disclosed in PCT Application No. 2013/162926, the disclosure of which is incorporated herein by reference.

Another suitable organic solvent is an alkyl hydroxy butyrate. In particular, butyl-3-hydroxybutyrate. This organic solvent has a solvency greater than 100 and further has Hansen solubility parameters of dispersive: 16.13, polar: 6.541, and hydrogen bonding: 11.52.

Generally, the cleaning composition of the present invention will include 1.0 to 90% by weight of the organic solvent. More particularly, embodiments may include 0.5 to 50%, or 2 to 20%, such as 2, 3, 4, 5, 6, 7, 8, 9, 10, 15 or 20% by weight of the organic solvent.

In addition, the cleaning composition will have anon-aqueous organic carrier as well as a surfactant which combine to form a stable solution. One particular carrier suitable for use in the present invention is n-propyl propionate, which is a flammable carrier. One such n-propyl propionate is sold by Eastman Chemical Company. Other suitable carriers include pentyl propionate, n-butyl propionate, isobutyl isopropionate and glycol ether EB. In all the formulations set out herein, the amount of carrier will form the balance of the formulation up to 100%. Generally, the carrier will comprise 0.1 to 99% by weight, generally 50-90% of the total composition.

In addition to the carrier and the organic solvent, the present invention will include a surfactant or surfactant blend which is effective to maintain a stable solution. In various embodiments, non-ionic, cationic, and anionic surfactants are added to the carrier for emulsification of those challenging cleaning deposits. The cleaning composition may include a non-ionic surfactant. Any non-ionic surfactant which can form a micro emulsion between the carrier and the organic solvent can be utilized in the present invention. Typical non-ionic surfactants include the polyoxyethylene glycols, such asoctaethylene glycol monododecyl ether or pentaethylene glycol monododecyl ether; polyoxypropylene glycol; glucoside alkyl ethers such as decyl glucoside, lauryl glucoside or octyl glucoside; polyoxyethylene glycol octylphenol ethers, such as TRITON X-100®; polyoxyethylene glycol alkylphenol ethers, such as nonoxynol-9; glycerol alkyl esters, such as glyceryl laurate; polyoxyethylene glycol sorbitan alkyl esters, such as polysorbate; sorbitan alkyl esters; cocamide MEA; cocamide DEA; dodecyldimethylamine oxide; block copolymers of polyethylene glycol and polypropylene glycol and polyethoxylated tallow amine, as well as many others. These non-ionic surfactants must be effective to produce microemulsions of the carrier and the organic solvent. Such suitable non-ionic surfactants also include alkoxylated alcohols and modified alkoxylated alcohols, such as DeIONIC LF and DeIONICLF-EP-15 from DeForest Enterprises, Inc. Another suitable surfactant includes a ethoxylated alcohol ester, such as DeMULS KE-75 from DeForest Enterprises, Inc. Another suitable surfactant includes a modified alcohol ethoxylate, such as DeTERGELF-2379 from DeForest Enterprises, Inc. Generally, the cleaning composition will include from 0.5 to 5% by weight of the non-ionic surfactant. A blend of cationic and nonionic surfactants can be used. One such surfactant blend is Berol 226SA from Akzo Nobel Surface Chemistry LLC. This surfactant is blend of nonionic surfactant Ethoxylated Alcohol and Cationic Quaternary Amine Compound. Generally, the surfactant will be 0.1 weight % to about 50 weight % of the cleaning composition.

The surfactant may generally support wetting. However, in various embodiments, the composition of the present invention will include a wetting agent added separately to support better spreading and better cleaning. Wetting agents will be used from 0.1 weight % to about 20 weight %, typically about 1.0 weight %. Typical wetting agents include surface active agents (surfactants). One such wetting agent suitable for the present invention is Easy-Wet 20 from Ashland Inc. which is a blend of multiple nonionic surfactants; Undecyl Alcohol+EOPolyethoxylate, 1-Octyl-2-Pyrrolidone, 1-Undecanol and anionic surfactant, Sodium Lauryl Sulfate. Easy-Wet 20 significantly reduces surface tension at 0.02 weight % to less than 30 dynes/cm. This can be used in an amount from 0.1 to 20% by weight. Another such wetting agent suitable for the present invention is DeTROPE CA-100 from DeForest Enterprises, Inc., which is a modified carboxylate corrosion inhibitor and wetting agent. Another such wetting agent suitable for the present invention is DeSULF-80-LF35 from DeForest Enterprises, Inc. Another such corrosion inhibitor and wetting agent suitable for the present invention isBurco RP-8888 from Burlington Chemical Co. Inc.

Embodiments of the present invention can also include a chelating agent such as iminodi succinate sodium salt. If present, the chelating agent can form 0.1 to 20% by weight of the formulation. The chelating agent acts to bind metal ions present in the released grime. The formulation can further include a corrosion inhibitor to protect cleaned metal, generally present in an amount from about 0.1 to 10.0%.

Embodiments of the present invention can further include a fragrance and biocide. Fragrance is present at whatever amount is desired, generally from 0.001 to 1.0% by weight, and the biocide is generally present in an amount from 0.01 to 2.0%. Such fragrances suitable for the present invention is Mango Odor synthesis Fragrance F-148707 and Spearmint Odor synthesis Fragrance from Intarome Fragrance and Flavor Corp.

Preferably, the cleaning composition should have a basic pH generally in the range of 9-11 and in particular about 10.5. If necessary, a base, such as a sodium carbonate, can be added to alter the pH.

To form the cleaning composition of the present invention, the non-aqueous organic carrier and high solvency organic solvent are blended with the surfactant and the corrosion inhibitor. As this mixing continues, any other desired components, such as a chelating agent, fragrance, biocide, and finally the wetting agent are added in and mixing continued until a stable micro emulsion is formed.

This composition, due to the high solvency of the organic solvent, can be added to the induction air intake system of a gasoline engine as previously described to effectively remove buildup at the air intake valves. For example, the composition may be sprayed into the air intake while the engine is running. Additionally, the composition may be introduced into the fuel system, such as by a pressurized bottle, to clean it. The engine may run on the composition, burning or combusting it while the gas line/tank is disconnected. The composition may also be used in the fuel tank, mixed with gasoline to clean components in contact with gasoline such as the fuel injectors and combustion chamber. The composition may also be used in port fuel injected motors and carbureted engines. Lastly, the compositions described herein can be successfully mixed with common gasoline and hydrocarbon solvents (e.g., xylenes, toluene, etc.) to clean carbon from engine surfaces. The composition of the present invention can be used at any point in time during the life of the engine but typically will be utilized either after the engine has been used for a relatively long period of time, such as the time to go 100,000 miles in an automobile or truck, or when the gas mileage of an automobile or truck begins to decrease. Thus, it can be used on engines and vehicles that are experiencing reduced performance or simply periodically as preventive maintenance.

Generally, about 5 to about 100 ounces, or 20 to 40 ounces, of the cleaning composition will be introduced into the intake valve through the air induction system. Additional cleaning composition can be added if the deposits on the intake valves are particularly severe or if performance issues are confirmed by a borescope or OBD scan tool. The rate of injection should be approximately 3 gallons per hour.

Accordingly, the present invention provides cleaning compositions and methods of using the cleaning compositions to remove carbonaceous oily buildup on air intake valves of gasoline engines. This will effectively increase the life of the engine and provide improved overall performance. Suitable formulations containing high solvency, no fuel value solvents are listed below:

| Formula A | Weight (%) |
|---|---|
| Steposol Met-10U | 15.0 |
| Berol 226 SA | 15.0 |
| n-Propyl Propionate | 68.8 |
| Easy-Wet 20 | 1.0 |
| Mango Odorsynthesis Fragrance for Cleaning | 0.2 |

The above formulation was tested on a direct injected gasoline Hyundai Sonata (2.4 L GDI engine) with 23,000 miles. There were significant black deposits on the intake valves. As the car was running, the 44 oz of the above formulation was used in induction cleaning. The cleaning process resulted in cleaner intake valves. The above formulation was also tested on a direct injected gasoline Hyundai Sonata SE with 25,527 miles. There were significant black deposits on the fuel rails and piston tops. The cleaning process on the piston tops was after the fuel rail treatment and was conducted without induction cleaning. The cleaning process resulted in cleaner fuel rails and piston tops.

| Formula B | Weight (%) |
|---|---|
| Steposol Met-10U | 15.0 |
| Berol 226 SA | 15.0 |
| n-Propyl Propionate | 68.8 |
| Detrope CA-100 | 1.0 |
| Mango Odorsynthesis Fragrance for Cleaning | 0.2 |

| Formula C | Weight (%) |
|---|---|
| Steposol Met-10U | 10.0 |
| Steposol SC | 20.0 |
| DeIONICLF | 5.0 |
| n-Butyl Propionate | 75.0 |

| Formula D | Weight (%) |
|---|---|
| Steposol Met-10U | 10.0 |
| Steposol SB-W | 10.0 |
| Omnia | 10.0 |
| TomaKleen G-12 | 10.0 |
| n-Propyl Propionate | 60.0 |
| SpearmintOdorsynthesis Fragrance | 0.1 |

| Formula E | Weight (%) |
|---|---|
| Steposol Met-10U | 15.0 |
| Steposol SB-W | 15.0 |
| DeSULF-80-LF35 | 10.0 |
| DeIONICLF-EP-15 | 5.0 |
| n-Butyl Propionate | 55.0 |

| Formula F | Weight (%) |
|---|---|
| Radia 7543 | 10.0 |
| Steposol SB-W | 10.0 |
| Omnia | 10.0 |
| DeTERGELF-2379 | 10.0 |
| n-Propyl Propionate | 60.0 |

| Formula G | Weight (%) |
|---|---|
| Steposol Met-10U | 15.0 |
| Berol 226-SA | 15.0 |
| VertecBioElsolTR | 69.0 |
| Easy-Wet TM-20 | 1.0 |

| Formula H | Weight (%) |
|---|---|
| Steposol Met-10U | 15.0 |
| DeTERGE LF-2379 | 15.0 |
| DeTROPECA-lOO | 1.0 |
| VertecBio Clean ECO-Solv | 69.0 |

| Formula I | Weight (%) |
|---|---|
| Steposol Met-10U | 30.0 |
| Berol 226-SA | 30.0 |
| Easy-Wet 20 | 2.0 |
| n-Propyl Propionate | 38.0 |

| Formula J | Weight (%) |
|---|---|
| Steposol Met-10U | 15.0 |
| DeMULSKE-75 | 15.0 |

-continued

| Formula J | Weight (%) |
|---|---|
| Easy Wet 20 | 1.0 |
| n-Propyl Propionate | 69.0 |

| Formula K | Weight (%) |
|---|---|
| Steposol MET-10U | 7.0 |
| Berol 226-SA | 7.0 |
| Easy Wet 20 | 1.0 |
| n-Propyl Propionate | 52.0 |
| VertecBioElsolTR | 33.0 |

| Formula L | Weight (%) |
|---|---|
| Steposol MET-10U | 7.0 |
| Berol 226-SA | 7.0 |
| Easy Wet 20 | 1.0 |
| n-Propyl Propionate | 41.0 |
| VertecBioElsolTR | 41.0 |
| Water DI | 3.0 |

The above formulation was tested on a direct injected gasoline Hyundai Sonata (2.4 L GDI engine) with 28,866 miles. There were significant black deposits on the intake valves, fuel rails, and piston tops. As the car was running, the 44 oz of the above formulation was used in induction cleaning. The cleaning process on the piston tops was after the induction cleaning of the fuel rails. The cleaning process resulted in cleaner intake valves, fuel rails, and piston tops.

| Formula M | Weight (%) |
|---|---|
| Steposol MET-10U | 14.0 |
| Berol 226-SA | 14.0 |
| Easy Wet 20 | 1.0 |
| Burco RP-8888 | 2.0 |
| n-Propyl Propionate | 33.0 |
| VertecBioElsolTR | 33.0 |
| Water DI | 3.0 |

| Formula N | Weight (%) |
|---|---|
| Formula A | 50 |
| Toluene | 25 |
| Xylene | 25 |

The above formulation was tested on a direct injected gasoline Hyundai Sonata (2.4 L GDI engine) with 26,808 miles. There were significant black deposits on the intake valves. As the car was running, the 44 oz of the above formulation was used in induction cleaning. The cleaning process resulted in cleaner intake valves. The above formulation was also tested on a direct injected gasoline Hyundai Sonata with 27,217 miles. There were significant black deposits on the fuel rails and piston tops. The cleaning process on the piston tops was after the fuel rail treatment and was conducted without induction cleaning. The cleaning process resulted in cleaner fuel rails and piston tops.

This has been a description of embodiments of the present invention along with the methods of practicing the present invention.

What is claimed is:

1. A method of cleaning an air intake valve of an engine comprising:

introducing a cleaning composition into the air intake valve of said engine as said engine is running;

said cleaning composition comprising:

a micro-emulsion including an alkyl hydroxybutyrate having a Hansen solubility parameter/polar number greater than 6 and a fuel value sufficiently low that it does not combust in a gasoline engine and having a solvency effective to dissolve buildup on said valves;

an organic carrier; and a surfactant effective to establish a micro emulsion of said alkyl hydroxybutyrate and said organic carrier.

2. The method claimed in claim 1 wherein said surfactant is a nonionic surfactant.

3. The method claimed in claim 1 wherein said cleaning composition further includes a wetting agent.

4. The method claimed in claim 1 wherein said alkyl hydroxybutyrate has a Kb greater than 100.

5. The method claimed in claim 1 wherein said alkyl hydroxybutyrate has a Kb greater than 500.

6. The method claimed in claim 5 wherein said Kb is greater than 1000.

7. The method claimed in claim 1 wherein the organic carrier is selected from the group consisting of n-propyl propionate, pentyl propionate, n-butyl propionate, isobutyl isopropionate and glycol ether EB.

8. The method claimed in claim 1 wherein the surfactant is an alkoxylated alcohol.

9. The method claimed in claim 1 wherein the surfactant is an ethoxylated alcohol ester.

10. A method of cleaning an air intake valve of an engine comprising:

introducing a cleaning composition into the air intake valve of said engine as said engine is running;

said cleaning composition comprising:

a micro-emulsion including butyl 3-hydroxybutyrate having a Hansen solubility parameter/polar number greater than 6 and a fuel value sufficiently low that it does not combust in a gasoline engine and having a solvency effective to dissolve buildup on said valves;

an organic carrier; and a surfactant effective to establish a micro emulsion of said butyl 3-hydroxybutyrate and said organic carrier.

11. The method claimed in claim 10 wherein said surfactant is a nonionic surfactant.

12. The method claimed in claim 10 wherein said cleaning composition further includes a wetting agent.

13. The method claimed in claim 10 wherein said butyl 3-hydroxybutyrate has a Kb greater than 100.

14. The method claimed in claim 10 wherein said butyl 3-hydroxybutyrate has a Kb greater than 500.

15. The method claimed in claim 14 wherein said Kb is greater than 1000.

16. The method claimed in claim 10 wherein the organic carrier is selected from the group consisting of n-propyl propionate, pentyl propionate, n-butyl propionate, isobutyl isopropionate and glycol ether EB.

17. The method claimed in claim 10 wherein the surfactant is an alkoxylated alcohol.

18. The method claimed in claim 10 wherein the surfactant is an ethoxylated alcohol ester.

* * * * *